United States Patent [19]

Harada et al.

[11] Patent Number: 4,954,535

[45] Date of Patent: Sep. 4, 1990

[54] HIGH-DURABILITY PLATE BRICK FOR SLIDING GATE NOZZLE APPARATUS

[75] Inventors: Tsutomu Harada; Hiroshi Shikano, both of Kitakyushu, Japan

[73] Assignee: Kurosaki Refractories Co., Ltd., Kitakyushu, Japan

[21] Appl. No.: 252,084

[22] Filed: Sep. 30, 1988

[30] Foreign Application Priority Data

Oct. 15, 1987 [JP] Japan ..... 62-261336

[51] Int. Cl.[5] ..... C08K 3/08

[52] U.S. Cl. ..... 523/139; 523/458; 524/440

[58] Field of Search ..... 523/139, 458; 524/440; 222/600

[56] References Cited

FOREIGN PATENT DOCUMENTS 56-140064 11/1981 Japan .

*Primary Examiner*—Lewis T. Jacobs

*Attorney, Agent, or Firm*—Jordan and Hamburg

[57] ABSTRACT

2 to 15 wt % of a resin is added to a mixture of a refractory aggregate and a metal having a melting point of not higher than 1,000° C., the resin being obtained by added 10 to 90 wt % of a silicon resin to at least one kind of thermosetting resin which easily exhibits a higher mechanical strength when heated to about 150° to 250° C. The resultant mixture is molded and heated to a temperature of not higher than 1,000° C., thereby producing a high-durability plate brick for a sliding gate nozzle apparatus.

7 Claims, 1 Drawing Sheet

HIGH-DURABILITY PLATE BRICK FOR SLIDING GATE NOZZLE APPARATUS

BACKGROUND OF THE INVENTION

1. Field of the invention

The present invention relates to a plate brick for a sliding gate nozzle (hereinunder referred to as "SN") apparatus which is used for controlling a flow rate of a molten metal on casting.

2. Description of the Prior Art

An SN apparatus is generally composed of three parts, namely, an upper nozzle, a plate brick consisting of a fixed plate and a sliding plate, and a lower nozzle. Among these, the plate brick is a part which is required to have specialized properties for the function of controlling the flow rate of a molten metal.

Since the plate brick is subject to physical and chemical attack such a violent thermal shock and wear caused by a stream of molten metal, spalling resistance and corrosion resistance are the most important properties required for working the plate brick. Further, in order to obtain stable high durability, oxidation resistance and mechanical strength are also important properties to have in addition to the above properties.

The present inventors previously disclosed in Japanese Patent Publication No. 60-29664 an improved SN plate in resistance against the deterioration of the mechanical strength in the middle temperature range (400° to 700° C. and the spalling resistance and the corrosion resistance which is prepared by admixing 2 to 15 wt % of a thermosetting synthetic resin such as phenol resins, furan resins and epoxy resins with a refractory aggregate including 1 to 20 wt % of a powder of a low-melting metal having a particle size of not more than 0.5 mm, molding and heating the resultant mixture, to a temperature of not higher than 800° C.

Improvement in the mechanical strength of thus prepared SN plate brick was achieved by heating at temperatures from about 150° to 250° C.

There are, however, problems still remaining unsolved. For example improvement of mechanical strength at a temperature higher than 300° C., temperatures which the SN plate is in practical operation subjected to, cannot be expected due to oxidation in prior art SN plates.

SUMMARY OF THE INVENTION

Accordingly, an object of the present invention is to provide a plate brick for an SN apparatus having a mechanical strength at a temperature higher than 300° C. highly balanced with oxidation resistance as well as high corrosion and spalling resistance.

Such object can be achieved by employing a resin mixture consisting of one or more than two of thermosetting resins which easily exhibit a higher mechanical strength when heated to about 150° to 250° C. added with a silicon resin that has been known as a resin having properties including oxidation resistance when employed in a refractory material but also has been known as lacking in the ability improve mechanical strength.

As a refractory aggregate which the above resin mixture is admixed with, in the present invention, any of one or more than two selected from a group consisting of silica, alumina, silica alumina, magnesia, spinel, chromium ore, SiC, $Si_3N_4$, $B_4C$, BN and carbonaceous materials such as graphite and amorphous carbon is usable.

As the low-melting metal to be included in the refractory aggregate, at least one metal having a low melting point not higher than 1,000° C. and selected from the group consisting of Al, Mg, Zn, Sn, Ba and Pb and an alloy thereof is usable. The amount of the low-melting metal included in the refractory aggregate may be from 1 to 20 wt % and the particle size thereof may not exceed 0.5 mm preferably.

Examples of the thermosetting resin which easily exhibits a higher mechanical strength when heated to about 150° to 250° C., are a phenol resin, a furan resin and an epoxy resin. A resin which can be set at room temperature by use of a catalyst should be used as the thermosetting resin in this invention.

As a silicon resin, silicone resin is most preferable from the view point of oxidation resistance. The amount of silicon resin added to at least one resin of the above is 10 to 90 wt % based on the thermosetting resin employed. If the amount is less than 10 wt %, it is difficult to maintain stable high oxidation resistance. On the other hand, if the amount is more than 90 wt %, it is difficult to maintain stable mechanical strength. The mixed resin may be prepared before adding to the refractory aggregate, or may be added separately to the refractory aggregate in a mixer. The amount of resin mixture to be added is dependent on the bulk specific gravity of the refractory aggregate to a certain extent, but is preferably 2 to 15 wt %. If it is less than 2 wt %, molding becomes impossible; if more than 15 wt %, it makes molding difficult.

On preparing the SN plate brick, the refractory aggregate included with the low-melting point metal powder added with the resin mixture is subject to heating at a temperature lower than 1,000° C., usually a temperature from 100° to 300° C. But when the brick is required to have a higher strength, the molded mixture is heated to a temperature higher than 500° C. to 1,000° C. in a non-oxidizing atmosphere in order to melt the low-melting metal or react it with some components of the aggregate. The temperature for heating is not to be higher than 1,000° C. If it exceeds 1,000° C., the spalling resistance becomes inferior.

A plate brick for an SN apparatus according to the present invention exerts no deleterious influence on the sliding property, corrosion resistance and spalling resistance even when it is applied to a sliding plate, and enables the mechanical property and the oxidation resistance to be well balanced at a high level, thereby enhancing the durability.

The above and other objects, features and advantages of the present invention are made clear through the following description of the preferred embodiment thereof, taken in conjunction with the accompanying drawing.

DESCRIPTION OF THE PREFERRED EMBODIMENT

Figure 1:
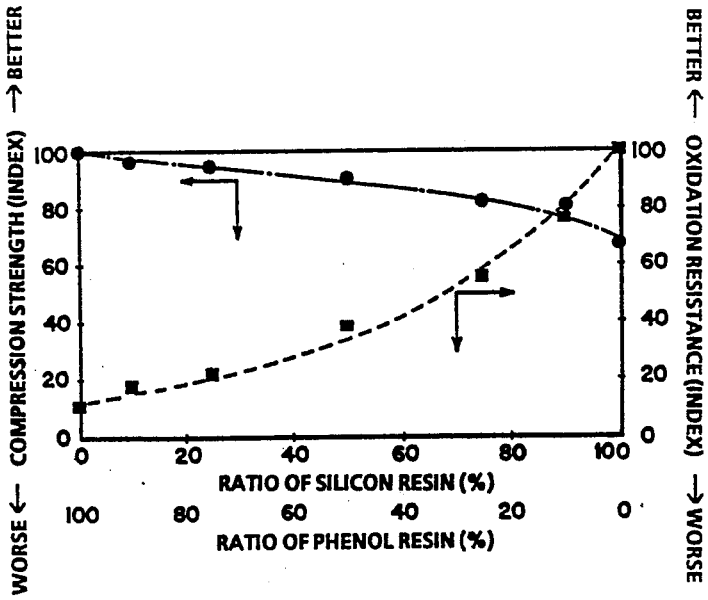
FIG. 1 shows a change in the mechanical strength (index of compression strength) and the oxidation resistance of a brick exhibited when the mixing ratio of a silicon resin and a phenol resin are varied in the composition shown in Table 1.

Alumina and aluminium were used respectively as the refractory aggregate and as the low-melting point metal. As a thermosetting resin which easily exhibits a higher mechanical strength when heated to about 150° to 250° C., a phenol resin was selected. The phenol resin was mixed with a silicon resin in ratios of 75:25, 50:50 and 25:75, respectively, and the aggregate and the resin mixture were heated in a bottom rotating mixer. The resultant mixture was molded in the form of a friction press plate, which was thermoset at 250° C. for 24 hours, thereby obtaining the plate for an SN apparatus. The compositions, the mixing ratios and the properties of the respective plates are shown in Table 1.

For comparison, a plate which contains no silicon resin and a plate which contains no phenol resin were produced by the same method, and the properties thereof are also shown in Table 1.

TABLE 1

| | Sample No. | | | | |
|---|---|---|---|---|---|
| Ingredient | 1 (Comp.) | 2 | 3 | 4 | 5 (Comp.) |
| Alumina powder | 91 | 91 | 91 | 91 | 91 |
| Clay powder | 2 | 2 | 2 | 2 | 2 |
| Carbon powder | 2 | 2 | 2 | 2 | 2 |
| Al | 5 | 5 | 5 | 5 | 5 |
| Phenol resin | +5 | +3.75 | +2.5 | +1.25 | — |
| Silicon resin | — | +1.25 | +2.5 | +3.75 | +5 |
| Properties | | | | | |
| Bulk specific gravity | 3.11 | 3.13 | 3.12 | 3.13 | 3.13 |
| Apparent porosity (%) | 10.6 | 10.0 | 9.9 | 8.9 | 7.8 |
| Compression strength ($kg/cm^{-2}$) | 1200 | 1136 | 1091 | 996 | 812 |
| BS Wear index* after oxidation (600° C. × 2 hr) | 270 | 134 | 74 | 52 | 29 |

*The smaller the numeral, the better.

As is obvious from Table 1, the mechanical strength is balanced well with the oxidation resistance in the samples 2, 3 and 4 which are in accordance with the present invention in comparison with the samples 1 and 5 in the comparative example.

When sample 3 was subjected to a practical test in an SN apparatus of a 60-ton ladle, it showed a remarkable improvement in durability compared with conventional bricks which had used only a phenol resin or a silicon resin. In addition, there was little deterioration of the sliding surface after use due to oxidation and deterioration of the construction due to physical wear. Thus, the test of sample 3 brought about very good results.

Furthermore, the mechanical strength (index of compression strength) and the oxidation resistance were measured while varying the ratio of the silicon resin and the phenol resin in the composition shown in Table 1. The results are shown in FIG. 1.

The compression strength (index) of each sample is indicated by the mark —●— on the assumption that the compression strength is 100 when the phenol resin contained is 100%.

The oxidation resistance index k was calculated from the following formula on the basis of the BS wear index of the surface of the brick measured after 2-hour oxidation treatment.

$$k = \frac{1}{BS \text{ wear index}} \times 100$$

The oxidation resistance index of each sample was represented by the mark . . . ■ . . . on the assumption that the compression strength is 100 when the silicon resin contained is 100%.

While there has been described what is at present considered to be a preferred embodiment of the invention, it will be understood that various modifications may be made thereto, and it is intended that the appended claims cover all such modifications as fall within the true spirit and scope of the invention.

What is claimed is:

1. A method of producing a high-durability plate brick for a sliding gate nozzle apparatus comprising mixing a refractory aggregate composition containing a metal having a melting point of not higher than 1000° C., a thermosetting resin exhibiting a higher mechanical strength when heated to about 150° to 250° C., and 10 to 90 wt % based on the amount of thermosetting resin of a silicon resin, the thermosetting resin and silicon resin being present in an amount of 2 to 15 wt % based on the amount of refractory aggregate composition, and heating the mixture to form said plate brick.

2. A method according to claim 1, further comprising mixing said thermosetting resin and said silicon resin prior to mixing with said refractory aggregate composition.

3. A method according to claim 1, comprising heating said mixture to a temperature of from 100° to 300° C.

4. A method according to claim 1, comprising heating said mixture to a temperature of from 500° to 1000° C. in a non-oxidizing atmosphere.

5. A method according to claim 1, wherein said silicon resin is silicone resin and said thermosetting resin is selected from the group consisting of phenol resin, furan resin, epoxy resin and mixtures thereof.

6. A method according to claim 1, wherein said metal is present in an amount of 1 to 20 wt % based on the amount of refractory aggregate composition, has a maximum particle size of 0.5 mm, and is selected from the group consisting of Al, Mg, Zn, Sn, Ba, Pb and alloys thereof.

7. A high-durability plate brick for a sliding gate nozzle apparatus produced according to the method of claim 1.

* * * * *